United States Patent [19]

Walter

[11] 4,136,901

[45] Jan. 30, 1979

[54] GOLF BALL RETRIEVER

[75] Inventor: Erhard P. Walter, Downsview, Canada

[73] Assignee: Howard C. David, Willowdale, Canada; a part interst

[21] Appl. No.: 863,898

[22] Filed: Dec. 23, 1977

[30] Foreign Application Priority Data

Dec. 20, 1977 [CA] Canada ..... 293469

[51] Int. Cl.[2] ..... A63B 47/02

[52] U.S. Cl. ..... 294/19 A

[58] Field of Search ..... 294/19 R, 19 A, 104; 56/327 R, 328 R, 332, 333; 273/32 F, 162 E

[56] References Cited

U.S. PATENT DOCUMENTS

| | | | |
|---|---|---|---|
| 2,623,769 | 12/1952 | Kegley | 294/19 A |
| 3,029,097 | 4/1962 | Ward | 294/19 A |
| 3,046,044 | 7/1962 | Christle | 294/19 A |
| 4,046,413 | 9/1977 | Jeninga | 294/19 A |

*Primary Examiner*—Johnny D. Cherry

*Attorney, Agent, or Firm*—George H. Riches and Associates

[57] ABSTRACT

This invention relates to an improved golf ball retriever of the type which may be lowered directly over the ball. The retriever has a telescopic handle for reaching into water hazards and the like. The handle is pivotally connected to a body member which has a pair of lower forwardly extending curved arms and a retaining ring pivotally connected at its rear to the body member at a point above the plane of the curved arms. Thus the retaining ring normally slopes forwardly downward and rests on the ends of the curved arms. The ring is slightly larger in diameter than a golf ball and when the retriever is lowered over a golf ball, the ring pivots slightly upward to increase the effective size of the opening between it and the curved arms to allow the ball to pass therethrough. When it has, the ring drops down past the outside of the ball, and the retriever is then lifted upwards with the ball engaged by the ring and the curved arms. The body member has an upper curved holding finger which prevents the ball from being dislodged and to which the handle is pivotally connected. This structure provides the advantage that the ball may be released simply by resting the body member on the ground and pulling forward on the handle. This automatically pivots the body portion about the ball and the retaining ring to release the ball. In other embodiments, the retaining ring may be rectangular or triangular with the body portion having arms to match.

7 Claims, 6 Drawing Figures

GOLF BALL RETRIEVER

BACKGROUND OF THE INVENTION

This invention relates generally to golf ball retrievers and more particularly to an improved golf ball retriever for retrieving golf balls from water hazards and other inaccessible places.

In the past, a number of different devices having long handles have been used to avoid the loss of costly golf balls. These generally have had the disadvantage that it is difficult to engage the ball and often the ball is merely dislodged to another position from which it cannot be recovered.

More recently, U.S. Pat. No. 3,029,097 issued Apr. 10, 1962 to Ward discloses an improved golf ball retriever whereby the ball may be engaged by lowering the device directly over the ball. However, the Ward device has the disadvantage that the ball must be manually removed from the device which involves some difficulty due to the fact that the handle is usually extended to be several feet long. Furthermore, a ball which has been removed from a water hazard is usually in a muddy or dirty condition and it is preferable that it be allowed to rest at a nearly grassy area while the retriever is being placed back in the golfer's bag. The ball may then be picked up and play resumed.

SUMMARY OF THE INVENTION

Accordingly, it is an object of the present invention to at least partially overcome the disadvantages of the prior devices by providing an improved golf ball retriever from which the golf ball may be released merely by manipulating the handle.

To this end, in one of its aspects, the invention provides a golf ball retriever comprising (a) a rigid body member having a substantially horizontal base portion, the base portion formed by a pair of arms extending forwardly to define a frontwardly open mouth therebetween, (b) a retaining member connected at the rear to the body member at a point above the base portion to pivot between a lower retaining position and an upper open position, the retaining member extending forwardly from the body member and having a retaining portion which extends substantially across the mouth of the base portion to support a golf ball therebetween in the retaining position, and (c) an elongated handle member connected to the body member.

Further objects and advantages of the invention will appear from the following description taken together with the accompanying drawings.

DESCRIPTION OF THE PREFERRED EMBODIMENTS

Figure 1:
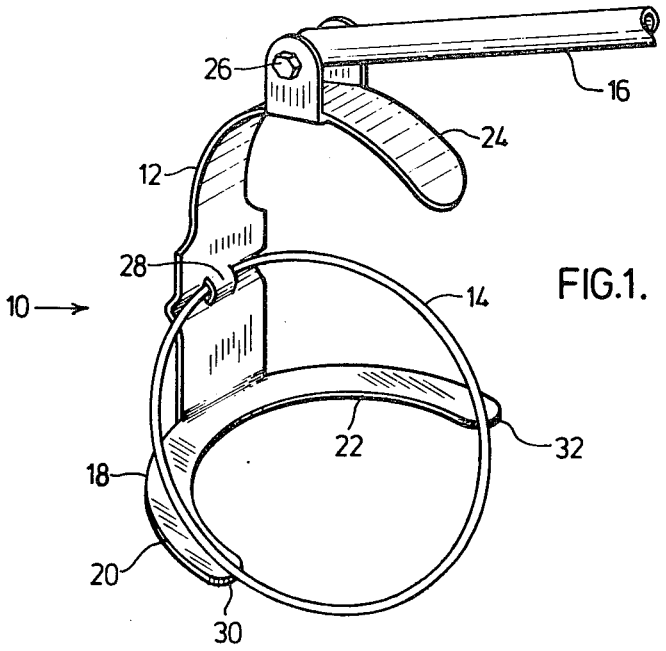
FIG. 1 is a partial perspective view of a golf ball retriever according to a first embodiment of the invention.

Reference is first made to FIG. 1 which shows a golf ball retriever 10 having a body member 12, a circular retaining member or ring 14 and a handle 16. The body member 12 has a forwardly extending base portion 18 which is formed by a pair of horizontally extending curved arms 20,22 and an upper curved holding portion or finger 24. As may be seen, the handle 16 is pivotally connected to the holding portion 24 of the body member 12 by pin 26. While only a portion of handle 16 is shown, it will be understood that it preferably will be telescopically extendible in a conventional manner. The retaining ring 14 is pivotally connected at the rear to the body member 12 at point 28 which is above the base portion 18. The retaining ring 14 is slightly larger in diameter than a golf ball and is located so that it will come to rest on the ends 30,32 of arms 20,22 under the influence of gravity when the retriever is lifted by the handle 16.

Figure 2:
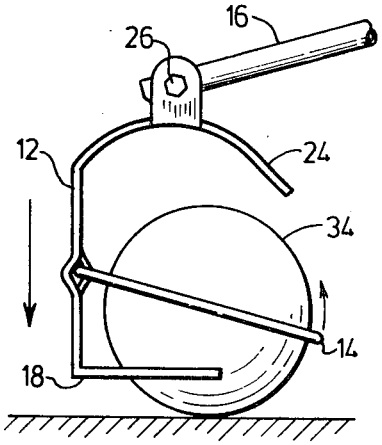
FIG. 2 is an elevation view of the retriever shown in FIG. 1 moving downwardly to engage a golf ball.
Figure 3:
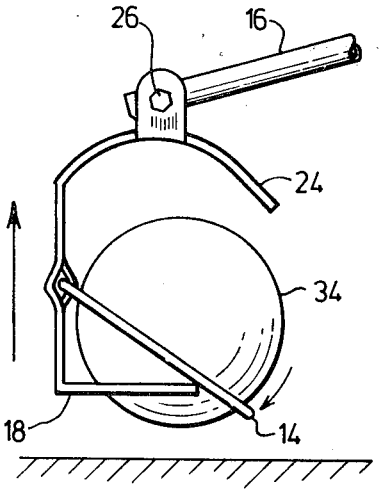
FIG. 3 is an elevation view of the retriever seen in FIG. 1 lifting the ball upwardly following engagement.
Figure 4:
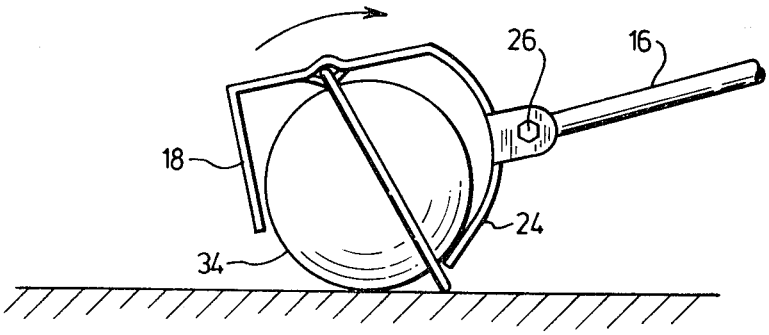
FIG. 4 is an elevation view of the retriever seen in FIG. 1 pivoting on a nearby surface to release the golf ball.

In use, referring to FIGS. 2 to 4, when the golf ball 34 has been located in an inaccessible location in a water hazard, the golfer takes the retriever 10 from his bag. He extends the handle 16 to the necessary length and lowers the body member 12 directly down over the ball 34 as seen in FIG. 2. When the retaining ring 14 is at rest in an inclined position on the ends 30,32 of arms 20,22, its effective diameter in a vertical direction is slightly less than that of the golf ball. Therefore, as the body member 12 is lowered down over the golf ball, the retaining ring 14 contacts the ball 34 and is pivoted slightly upwardly thereby until the effective diameter between the ring 14 and the arms 20,22 becomes sufficient to enable the ring to drop downwardly over the ball to engage the ball in the position shown in FIG. 3 with the ball resting on the ring and the curved arms. The golfer then raises the handle to lift the body member upward (as shown by the arrow in FIG. 3) to remove the ball from the water hazard.

The retriever is then swung around to a position over solid ground and then lowered until the ball 34 contacts the grass. The golfer then pulls forwardly on the handle 16 which causes the body member 12 to pivot forwardly about the golf ball and the retaining ring 14. As seen in FIG. 4, this has the effect of again increasing the effective diameter between the retaining ring 14 and the arms 20,22 to release the ball. The retriever may then be washed off in the water, the handle contracted, and placed back in the bag. The ball may then be cleaned and play resumed. Thus it may be seen that direct contact with the ball is avoided until it has been resting on the grass for a short period of time. If the ball is particularly dirty, it may be partially cleaned by moving it on the grass with the retriever or with the golfer's foot.

Figure 5:
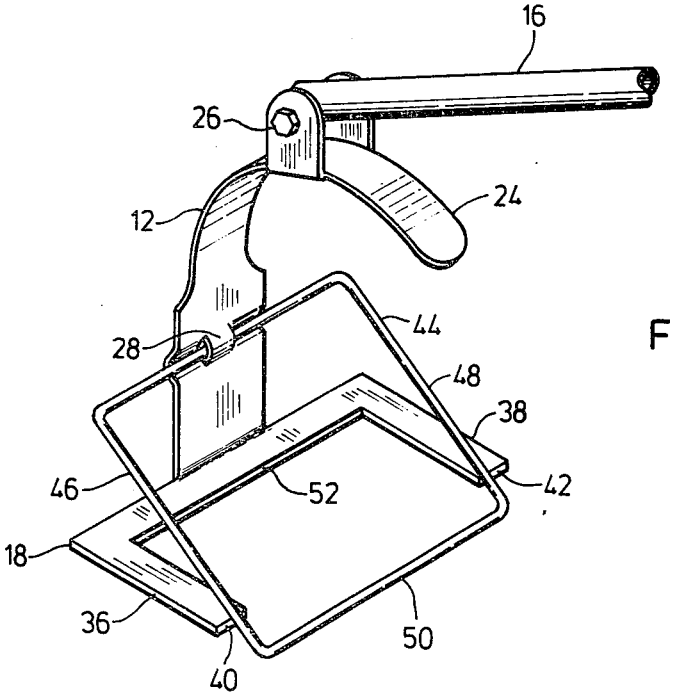
FIG. 5 is a perspective view of a golf ball retriever according to a second embodiment of the invention.

FIG. 5 illustrates the structure of a second embodiment of the retriever according to the invention, and as many of the features are identical to those of the first embodiment, features common to both embodiments are described and illustrated using the same reference numerals. As may be seen, the body member 12 differs in that the base portion 18 is formed with a pair of parallel forwardly extending arms 36,38 having ends 40,42 respectively. Similarly, the pivotal retaining member 44 is rectangular in shape having side portions 46,48 which rest on the respective ends 40,42 of the arms and a retaining portion 50 which engages the ball 34.

Operation of this embodiment is very similar to that of the first embodiment. As the body member 12 is lowered down over the ball, the retaining portion 50 of the retaining member 44 contacts the ball which pivots the retaining member slightly upward. This increases the distance between the retaining portion 50 and rear cross member 52 of the base portion 18 sufficiently to enable the ball to pass therethrough, and then the retaining member 44 pivots back downwardly under the force of gravity until the side portions 46,48 rest on the ends 40,42 of the arms 36,38. The ball may then be lifted from the water and released on a nearby grassy surface. Release is accomplished by pulling forwardly on the retriever handle when the body member is resting on the grass. The combination of gravity and the pulling effect causes the body member 12 to pivot about the ball and the retaining member 44 which increases the distance between the retaining portion 50 and the cross member 52 and releases the ball.

Figure 6:
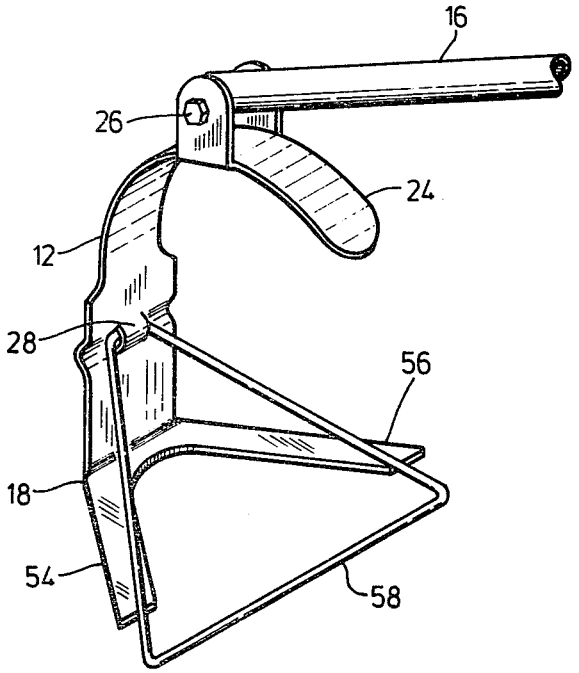
FIG. 6 is a perspective view of a golf ball retriever according to a third embodiment of the invention.

FIG. 6 illustrates the structure of a third embodiment of the invention. In this embodiment the base portion is formed with two diagonally extending arms 54,56 and the retaining member 58 is triangular in shape. Otherwise, the structure and operation is similar to that described above in regard to the first and second embodiments and need not be repeated.

Although the description of this invention has been given with respect to three particular embodiments of the retriever, it is not to be construed in a limiting sense. Many variations and modifications in configuration will occur to those skilled in the art. For a definition of the invention reference is made to the appended claims.

What I claim is:

1. A golf ball retriever comprising:

(a) a rigid body member having a substantially horizontal base portion, the base portion formed by a pair of arms extending forwardly to define a frontwardly open mouth therebetween;

(b) a retaining member connected at the rear to the body member at a point above the base portion to pivot between a lower retaining position and an upper open position, the retaining member extending forwardly from the body member and having a retaining portion which extends substantially across the mouth of the base portion to support a golf ball therebetween in the retaining position, and (c) an elongated handle member connected to the body member.

2. A golf ball retriever as claimed in claim 1 wherein the handle member is pivotally connected to the body member whereby the body member may be easily pivoted forwardly by engagement with the ground by manipulating the handle, thereby moving the retaining member upwards from the retaining position to release the golf ball.

3. A golf ball retriever as claimed in claim 2 wherein the body member further includes an upper holding portion which extends above the base portion of the body member and the retaining member to prevent the golf ball escaping from the device when the retaining member is in the retaining position.

4. A golf ball retriever as claimed in claim 3 wherein the holding portion is a curved arm extending forwardly above the retaining member and the handle is pivotally connected to the curved arm at a point substantially centrally above the golf ball when it is in position in the retriever.

5. A golf ball retriever as claimed in claim 1 wherein the retaining member is a ring slightly larger in a diameter than a golf ball.

6. A golf ball retriever as claimed in claim 1 wherein the retaining member is rectangular shaped and of sufficient size to receive a golf ball therethrough.

7. A golf ball retriever as claimed in claim 1 wherein the retaining member is triangular shaped and of sufficient size to receive a golf ball therethrough.

* * * * *